US007721705B2

(12) United States Patent
Sato et al.

(10) Patent No.: US 7,721,705 B2
(45) Date of Patent: May 25, 2010

(54) THROTTLE MANAGEMENT APPARATUS FOR AN INTERNAL COMBUSTION ENGINE, AND ENGINE INCORPORATING SAME

(75) Inventors: Junya Sato, Saitama (JP); Takashi Udono, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 275 days.

(21) Appl. No.: 11/893,204

(22) Filed: Aug. 15, 2007

(65) Prior Publication Data

US 2008/0184958 A1 Aug. 7, 2008

(30) Foreign Application Priority Data

Sep. 26, 2006 (JP) ..... 2006-260690

(51) Int. Cl.
*F02D 9/10* (2006.01)
*F02D 9/00* (2006.01)

(52) U.S. Cl. ..... 123/336; 123/400

(58) Field of Classification Search ..... 123/336, 123/337, 350, 363, 376, 399, 401, 403, 184.31
See application file for complete search history.

(56) References Cited

U.S. PATENT DOCUMENTS 4,462,357 A * 7/1984 Lockhart ..... 123/336
5,178,112 A * 1/1993 Terazawa et al. ..... 123/399
5,367,997 A * 11/1994 Kawamura et al. ..... 123/399
7,152,580 B2 * 12/2006 Wetor et al. ..... 123/376
2004/0244768 A1 * 12/2004 Udono ..... 123/336

FOREIGN PATENT DOCUMENTS

JP 2002-256900 9/2002
JP 2005282464 A * 10/2005

* cited by examiner

*Primary Examiner*—Mahmoud Gimie
(74) *Attorney, Agent, or Firm*—Carrier, Blackman & Associates, P.C.; William D. Blackman; Joseph P. Carrier

(57) ABSTRACT

A throttle management apparatus for an internal combustion engine is provided which allows the response of the engine to an operator's request to be improved while allowing the output characteristic of the engine to be controlled arbitrarily. The throttle management apparatus controls plural throttle valves provided for plural cylinders respectively. The throttle management apparatus includes an electric throttle management apparatus which electrically drives the throttle valves for some of the cylinders based on an electric signal generated according to selected operating conditions of the vehicle, and a mechanical throttle management apparatus which, through throttle activation member operation, mechanically drives the throttle valves for the rest of the cylinders. In an engine having a V type cylinder head configuration, the electric throttle management apparatus controls the throttle valves of one cylinder bank of the cylinder bank pair, while the mechanical throttle management apparatus controls the throttle valves of the other cylinder bank.

18 Claims, 6 Drawing Sheets

THROTTLE MANAGEMENT APPARATUS FOR AN INTERNAL COMBUSTION ENGINE, AND ENGINE INCORPORATING SAME

CROSS-REFERENCE TO RELATED APPLICATIONS

The present invention claims priority under 35 USC 119 based on Japanese patent application No. 2006-260690, filed on Sep. 26, 2006. The subject matter of this priority document is incorporated by reference herein.

BACKGROUND OF THE INVENTION

1. Field of the Invention

The present invention relates to throttle control systems for internal combustion engines, and to engines incorporating such throttle control systems. More particularly, the present invention relates to a control system which combines both mechanical and electronic control features.

2. Description of the Background Art

In the field of throttle control devices for internal combustion engines, it is well known to provide an electric (by-wire) throttle control device for controlling a throttle valve provided for each cylinder of a V-type internal combustion engine. In such an electric throttle management apparatus, an actuator is disposed between throttle bodies attached to front and rear cylinder banks, and the actuator is driven based on an electric signal generated by throttle operation. An electric throttle management apparatus of this type is disclosed, for example, in Japanese published patent document JP-A 2002-256900.

The technique disclosed in JP-A 2002-256900 makes it possible to arbitrarily control the output characteristic of an internal combustion engine through appropriate throttle operation. In the disclosed technique, however, all the throttle valves provided for individual cylinders are driven by one actuator, whereby an electrical control delay or driving delay is allowed to occur. Thus, when using the disclosed technique, it is difficult to improve the response speed of an internal combustion engine to an operator's request.

The present invention has been made in view of the above situation, and an object of the present invention is to provide a throttle management apparatus for an internal combustion engine which improves the response speed of an internal combustion engine to an operator's request, while arbitrarily controlling the output characteristic of the internal combustion engine.

SUMMARY OF THE INVENTION

To achieve the above object, in a first aspect of the invention, a throttle management apparatus for an internal combustion engine is disclosed which controls a plurality of throttle valves provided for a plurality of cylinders, respectively. The throttle management apparatus is characterized in that it includes a first throttle control device which electrically drives the throttle valves for some of the plurality of cylinders based on an electric signal generated according to selected operating conditions of a vehicle. The throttle management apparatus also includes a second throttle control device which, through manual operation of a throttle activation member such as a throttle grip or lever, mechanically drives the throttle valves for the rest of the plurality of cylinders.

In a second aspect of the invention, the throttle management apparatus for an internal combustion engine according to the first aspect of the invention is further characterized in that the second throttle control device has a correction device for correcting opening amounts of the throttle valves for the rest of the plurality of cylinders based on the electric signal generated according to selected operating conditions of the vehicle.

In a third aspect of the invention, the throttle management apparatus for an internal combustion engine according to the second aspect of the invention is further characterized in that the plurality of cylinders are grouped in banks, and the axes of the respective banks are arranged to form a V shape. In addition, an actuator of the first throttle control device and an actuator of the correction device are disposed within the V-shaped opening between the respective banks such that the actuators are longitudinally in parallel with a crankshaft disposed inside of the engine, while the actuators are mutually overlapping as viewed in a vertical direction.

In a fourth aspect of the invention, the throttle management apparatus for an internal combustion engine according to the second aspect of the invention is further characterized in that the plurality of cylinders are grouped in banks, and the axes of the respective banks are arranged to form a V shape, and an actuator of the first throttle control device and an actuator of the correction device are disposed between the plurality of cylinders arranged to form a V shape. In addition, the actuator of the first throttle control device drives the throttle valves for those cylinders of the plurality of cylinders which are included in a first cylinder bank. The second throttle control device, having the correction device, drives the throttle valves for the remaining cylinders, that is, those cylinders of the plurality of cylinders which are included in the other, or second, cylinder bank.

According to the first aspect of the invention, the first throttle control device electrically drives the throttle valves for some of the plurality of cylinders based on an electric signal generated according to selected operating conditions of the vehicle, so that the output characteristic of the internal combustion engine can be controlled arbitrarily. Also, the second throttle control device, through throttle grip operation, mechanically drives the throttle valves for the rest of the plurality of cylinders, so that, particularly during an early stage of throttle grip operation, the throttle valves can be driven by the second throttle control device with good response. This makes it possible, while electrically controlling the throttle valves, to improve the response speed of the internal combustion engine to an operator's request, namely, to improve the linearity in throttle response.

According to the second aspect of the invention, the correction device included in the second throttle control device corrects throttle valve opening amounts based on the electric signal generated according to selected operating conditions of the vehicle. It is therefore possible, using the second throttle control device, to arbitrarily set characteristics of the throttle valves without deterioration in the response during an early stage of throttle grip operation. This makes it possible to more arbitrarily control the output characteristic of the internal combustion engine.

According to the third aspect of the invention, the actuators of the first throttle control device and correction device are disposed so as to be longitudinally in parallel with the crankshaft, and between the cylinders whose axes are arranged in a V shape. By providing the actuators in this configuration, the actuators are disposed without requiring the angle formed by the V bank to be enlarged. Since the actuators are positioned to overlap each other as viewed in a vertical direction, they can be compactly disposed without interfering with each other in the longitudinal direction.

According to the fourth aspect of the invention, the actuator of the first throttle control device drives the throttle valves for cylinders included in one of the cylinder banks which constitute the V bank, and the second throttle control device having the correction device drives the throttle valves for cylinders included in the other of the cylinder banks which constitute the V bank. Therefore, the respective drive mechanisms of the first throttle control device and the second throttle control device including the correction device can be simplified. Also, employing a configuration in which the throttle opening amounts minutely differ between the two banks makes it possible to minutely control the output of the internal combustion engine without increasing the resolutions of the actuators.

Modes for carrying out the present invention are explained below by reference to an exemplary, non-limiting embodiment of the present invention shown in the attached drawings. The above-mentioned object, other objects, characteristics and advantages of the present invention will become apparent form the detailed description of the embodiment of the invention presented below in conjunction with the attached drawings.

DETAILED DESCRIPTION

A selected illustrative embodiment of the invention will now be described in some detail, with reference to the drawings. It should be understood that only structures considered necessary for clarifying the present invention are described herein. Other conventional structures, and those of ancillary and auxiliary components of the system, are assumed to be known and understood by those skilled in the art.

Figure 1:
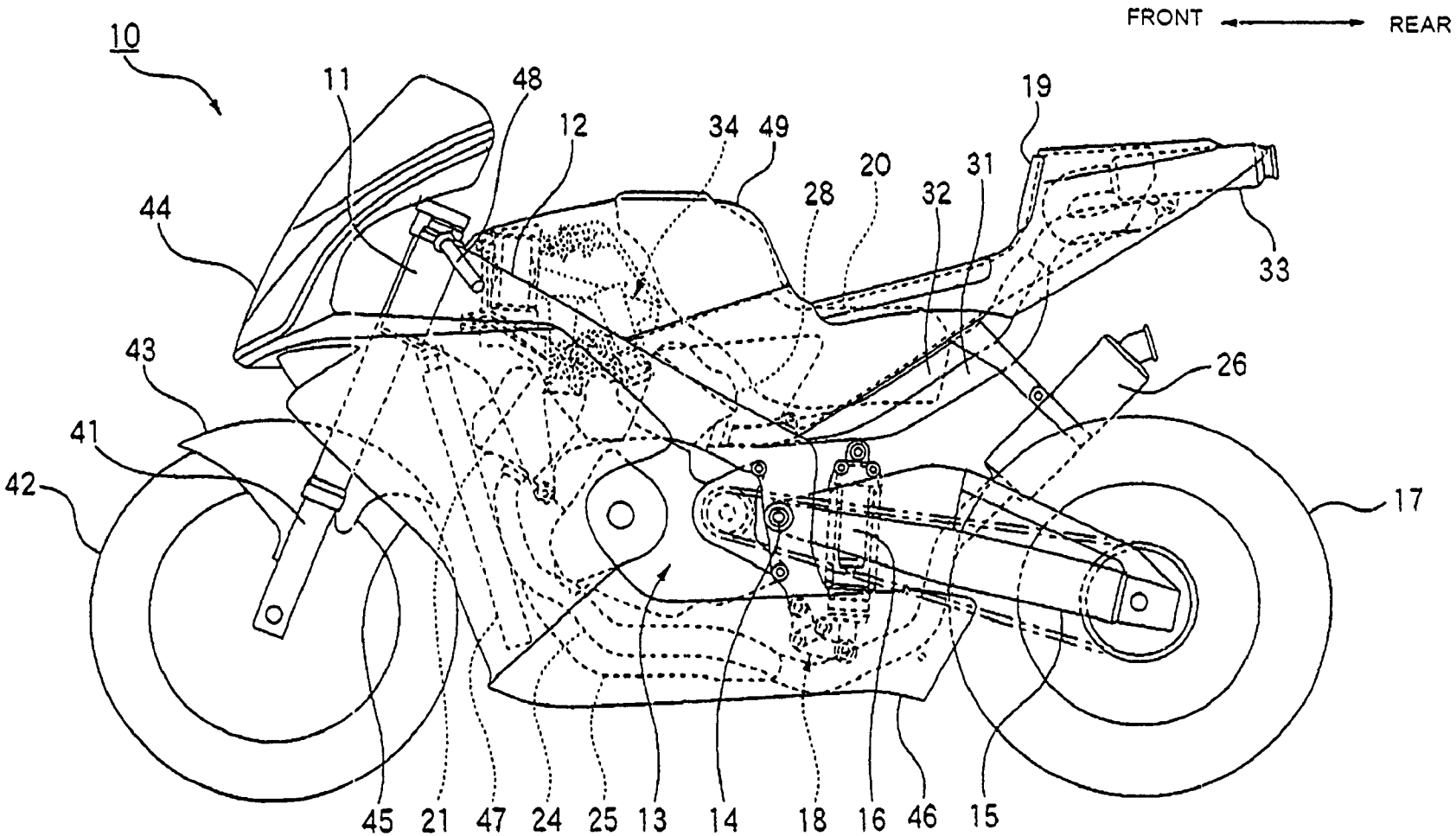
FIG. 1 is a side view of a motorcycle powered by an internal combustion engine which employs an embodiment of the throttle management apparatus according to the present invention.

First, the configuration of a motorcycle to which the present invention is applied will be outlined with reference to FIG. 1. Note that, in the following, the directions front, rear, left, and right are as seen in the forward direction of the motorcycle.

In a motorcycle 10, a pair of left and right mainframes 12 (only one is shown) extend rearwardly and downwardly from a head pipe 11. A V-type multi-cylinder internal combustion engine 13 is mounted under the mainframes 12. A swing arm 15 is vertically swingably attached to a rear portion of the mainframes 12 via a pivot shaft 14. An upper end portion of a rear shock absorber unit 16 is attached to an upper front portion of the swing arm 15. A rear wheel 17 is attached to a rear end portion of the swing arm 15. A lower end portion of the rear shock absorber unit 16 is attached to a lower rear end portion of the mainframes 12 via a link unit 18. A seat cowl 19, serving also as a seat, extends rearwardly from above the mainframes 12. A fuel tank 20 is installed inside the seat cowl 19.

Exhaust pipes 24 and 25 are provided for each of the plural cylinders residing in a respective front cylinder head 21 of the V-type multi-cylinder engine 13, and extend rearward from the respective front cylinder head 21. The exhaust pipes 24 and 25 are merged together and connected to an inner right muffler 26. Exhaust pipes 31 and 32 provided for each of the plural cylinders of the engine 13 residing in a respective rear cylinder head 28 of the engine 13, and extend rearward from the respective rear cylinder head 28. The exhaust pipes 31 and 32 are merged together and connected to a rear muffler 33 provided in a rear portion of the vehicle body. An intake mechanism 34 provided with the throttle management apparatus according to the present invention is installed between the cylinder heads 21 and 28 of the engine 13.

A front fork 41 is rotatably attached to the head pipe 11, a front wheel 42 is attached to a lower end portion of the front fork 41, and a front fender 43 covers an upper portion of the front wheel 42. The motorcycle 10 also includes an upper cowl 44, a middle cowl 45, a lower cowl 46, a radiator 47, a handlebar 48, and a tank cover 49.

Figure 2:
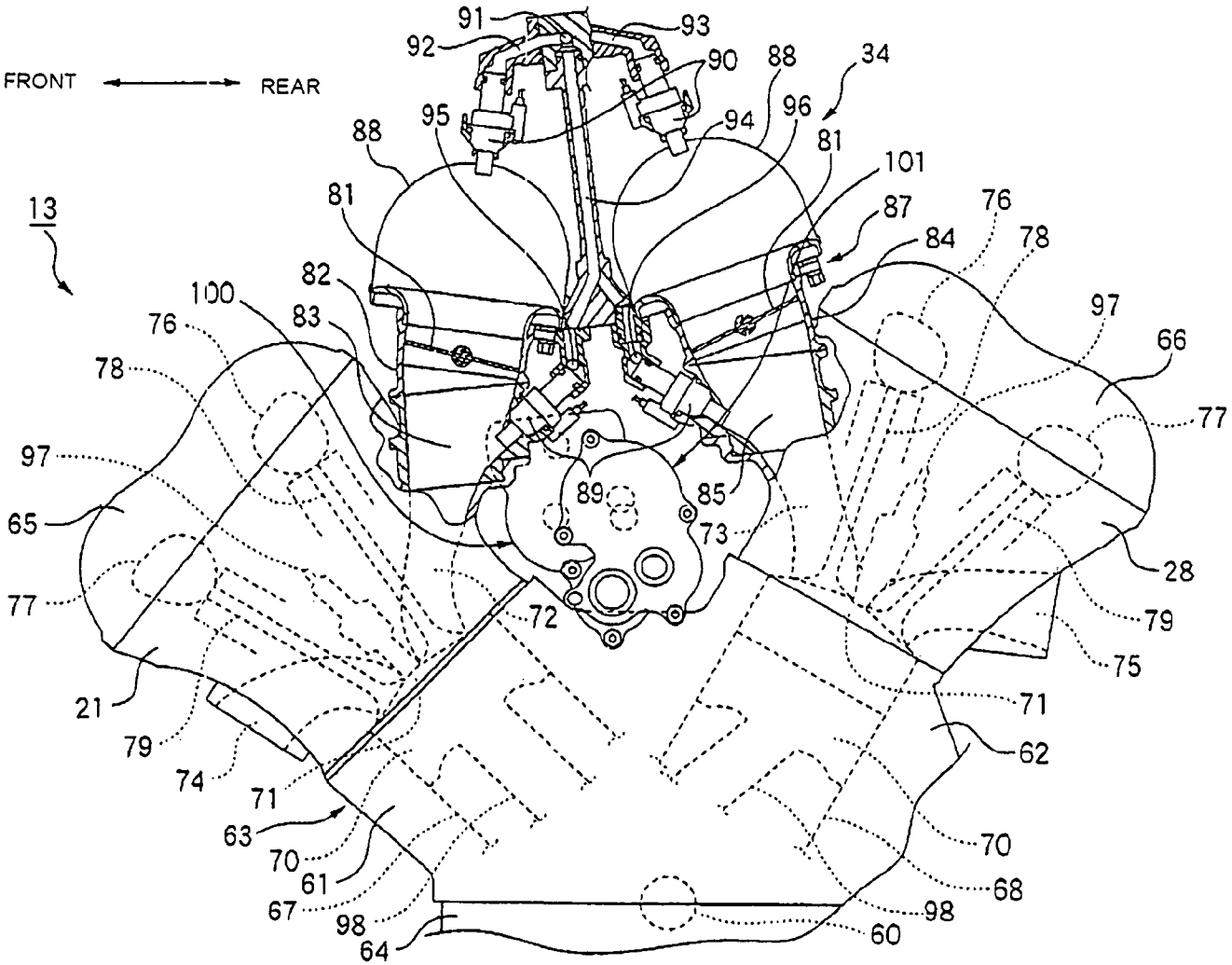
FIG. 2 is an enlarged side view of an upper portion of the internal combustion engine of FIG. 1, showing an intake mechanism including an electric throttle management apparatus and a mechanical throttle management apparatus disposed between the front bank and the rear bank the V-type engine.

Referring now to FIG. 2, the V-type multi-cylinder engine 13 is a V-type water-cooled, DOHC, four-cylinder engine mounted transversely on the motorcycle 10 such that a crankshaft 60 of the engine 13 is oriented in the lateral direction of the motorcycle. The V-type multi-cylinder engine 13 includes a cylinder block 63 having a front bank 61 and a rear bank 62, the front and rear banks 61 and 62 arranged so as to form a V bank. The engine 13 also includes a crankcase 64 coupled to a lower portion of the cylinder block 63, a front cylinder head 21 and a rear cylinder head 28 coupled to upper end portions of the front bank 61 and the rear bank 62, respectively, and a front head cover 65 and a rear head cover 66 coupled to upper end portions of the front cylinder head 21 and the rear cylinder head 28, respectively.

Plural parallel-disposed cylinders 67 (one only is shown) constitute the front bank 61 and plural parallel-disposed cylinders 68 (one only is shown) constitute the rear bank 62. In the illustrated embodiment, two cylinders are provided in each of the front bank 61 and the rear bank 62, but the invention is not limited thereto. The front 61 and rear 62 banks are configured such that the axes of the cylinders 67 and 68 are arranged in a V shape. A piston 70 is slidably fitted in each of the cylinders 67 and 68. A combustion chamber 71 is formed between each of the pistons 70 and the cylinder head 21 or 28. The cylinder head 21 includes a pair of intake ports 72 and a pair of exhaust ports 74 for the two cylinders 67 making up the front bank 61, the intake ports 72 each having an air inlet open to the corresponding one of the combustion chambers 71 and the exhaust ports 74 each having an air outlet open to the corresponding one of the combustion chambers 71. The cylinder head 28 includes a pair of intake ports 73 and a pair of exhaust ports 75 for the two cylinders 68 making up the rear bank 62, the intake ports 73 each having an air inlet open to the corresponding one of the combustion chambers 71 and the exhaust ports 75 each having an air outlet open to the corresponding one of the combustion chambers 71. Each pair of air inlets and each pair of air outlets in each of the cylinder heads are opened and closed at prescribed timing by a pair of intake valves 78 and a pair of exhaust valves 79 operated by an intake cam shaft 76 and an exhaust cam shaft 77 rotationally driven by the power of a crankshaft 60.

Figure 3:
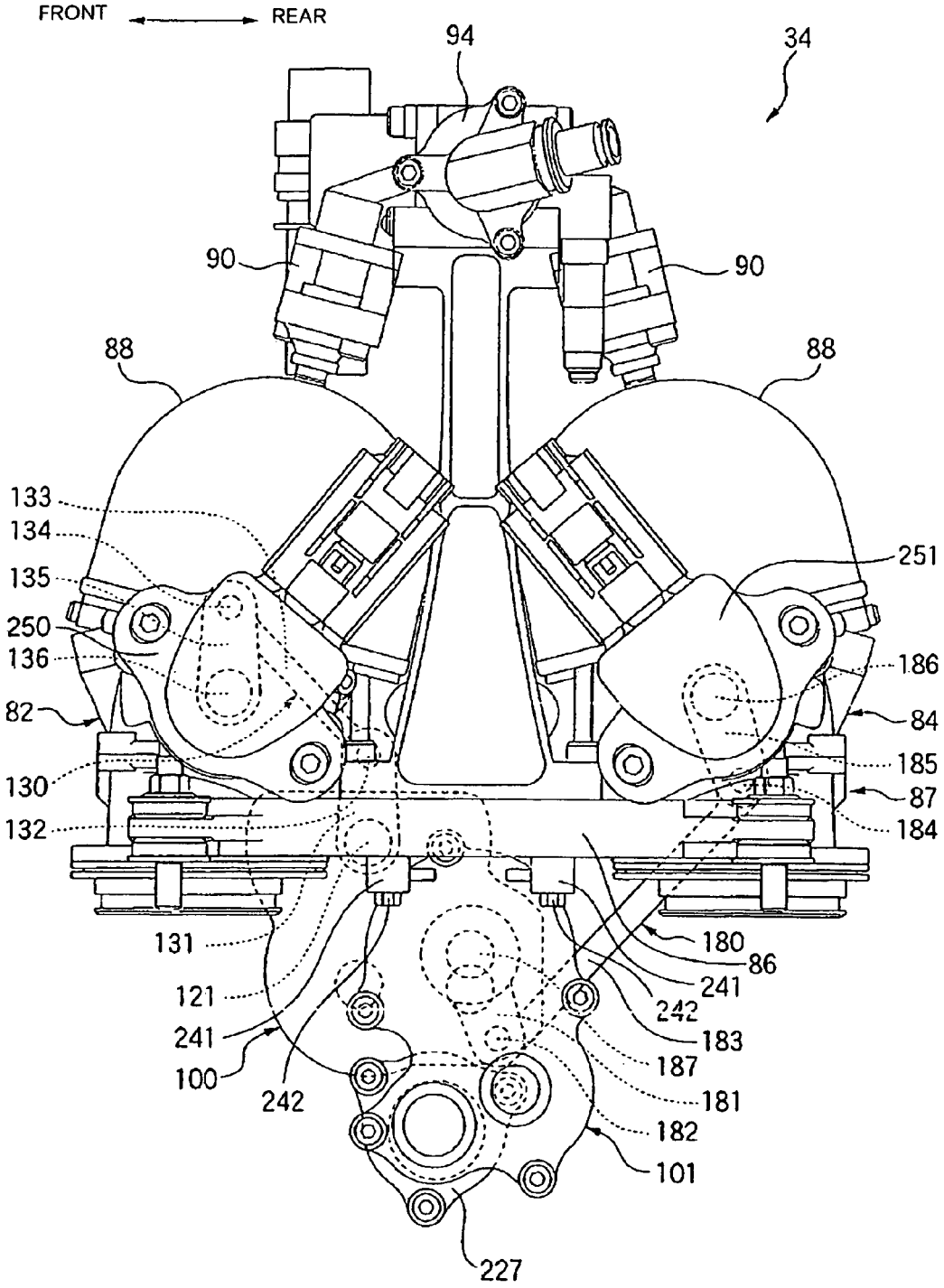
FIG. 3 is a side view of the intake mechanism and the throttle management apparatus of FIG. 2.

As shown in FIGS. 2 and 3, the intake mechanism 34, disposed between the front bank 61 and the rear bank 62 forming the V bank, has a throttle body 87 which includes a front throttle body section 82, a rear throttle body section 84, and a connection section 86 connecting the front and rear throttle body sections 82 and 84. In the front throttle body section 82, two intake paths 83 are formed which communicate with the intake ports 72 of the two cylinders 67 included in the front bank 61, each of the intake paths 83 being internally provided with a throttle valve 81. In the rear throttle body section 84, two intake paths 85 are formed which communicate with the intake ports 73 of the two cylinders 68 included in the rear bank 62, each of the intake paths 85 being internally provided with a throttle valve 81.

In each of the front throttle body valve section 82 and the rear throttle body valve section 84, a first injection valve 89 is provided downstream of the throttle valve 81 included in each of the intake paths 83 and 85. A wire-mesh flame trap 88 is fitted at a top portion of each of the intake paths 83 and 85 included in the front and rear throttle body sections 82 and 84, respectively. A second fuel injection valve 90 is disposed upward of the flame trap 88.

In the present embodiment, a fuel supply pipe 91 is disposed along the axial direction of the crankshaft 60, between the front and rear banks 61 and 62 making up the V bank. The fuel supply pipe 91 is branched into branch supply pipes 92 and 93, allowing fuel to be supplied from the fuel supply pipe 91, via the branch supply pipes 92 and 93, to the second fuel injection valves 90 for the two cylinders 67 and the two cylinders 68 of the front and rear banks 61 and 62, respectively. The fuel from the fuel supply pipe 91 is also sent, via a communication pipe 94, to fuel pipes 95 and 96 to be then supplied to the first fuel injection valves 89 for the two cylinders 67 included in the front bank 61 and the two cylinders 68 included in the rear bank 62, respectively.

The fuel injected from the first and second fuel injection valves 89 and 90 is mixed with air taken in through the intake paths 83 and 85 to generate air-fuel mixtures which are introduced into the combustion chambers 71 via the intake ports 72 or 73. The air-fuel mixture introduced into each of the combustion chambers 71 is ignited by a spark plug 97 and burns. The resultant combustion pressure generated moves the piston 70 reciprocally, causing the piston 70 to rotationally drive the crankshaft 60 via a connecting rod 98.

As shown in FIG. 2, an electric throttle management apparatus 100, which is a first throttle control device, and a mechanical throttle management apparatus 101, which is a second throttle control device, are disposed between the two intake paths 83 included in the front throttle body section 82, and the two intake paths 85 included in the rear throttle body section 84. As described above, the intake paths 83 and 85 are disposed between the two cylinders 67 included in the front bank 61 and the two cylinders 68 included in the rear bank 62, the two cylinders 67 and the two cylinders 68 being disposed to form a V shape.

Based on an electric signal generated according to selected operating conditions of the vehicle, the electric throttle management apparatus 100 electrically drives the two throttle valves 81 for the two cylinders 67 included in the front bank 61 out of the throttle valves 81 for the cylinders 67 and 68 of the two banks making up the V bank. The "selected operating conditions of the vehicle" refer to various parameters including those indicative of selected operating conditions of the internal combustion engine: for example, throttle condition, vehicle speed, acceleration, and wheel slip ratio.

Figure 5:
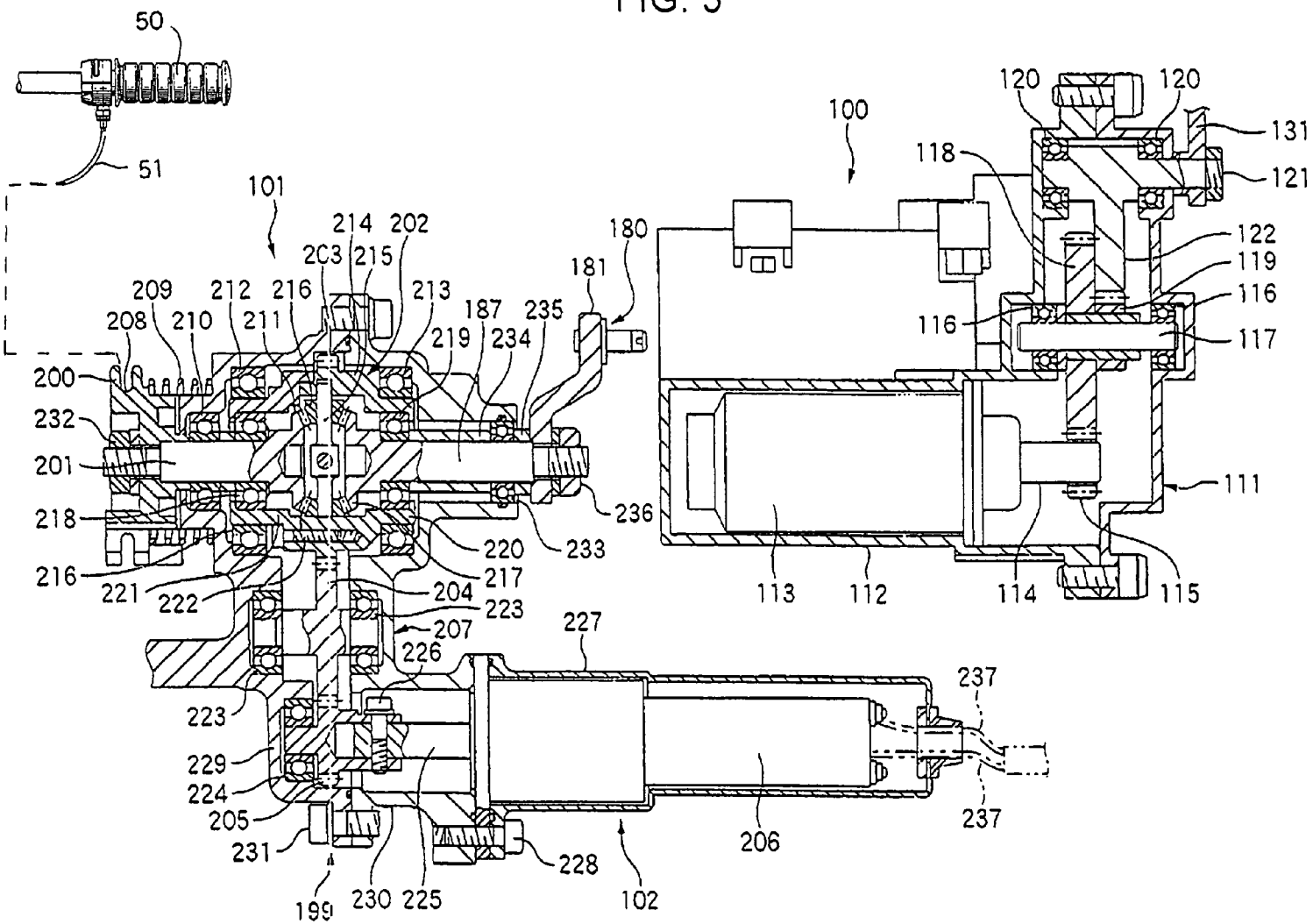
FIG. 5 is a cross-sectional view of an exemplary throttle management apparatus used in the embodiment.

As shown in FIG. 5, the electric throttle management apparatus 100 is housed in a case 111 and a motor housing section 112, the motor housing section 112 having a bottomed cylindrical shape and being provided in the case 111. The electric throttle management apparatus 100 includes an actuator 113 longitudinally extending in parallel with the crankshaft 60, a first small gear 115 mounted on a drive shaft 114 of the actuator 113, a support shaft 117 supported, via a pair of bearings 116, by the case 111, a large gear 118 fixed to the support shaft 117 and engaging the first small gear 115, a second small gear 119 which is fixed to the support shaft 117 and rotates integrally with the large gear 118, an output shaft 121 supported, via a pair of bearings 120, by the case 111 and partly projecting from the case, and a fan-shaped output gear 122 formed integrally with the output shaft 121 and engaging the second small gear 119.

Figure 6:
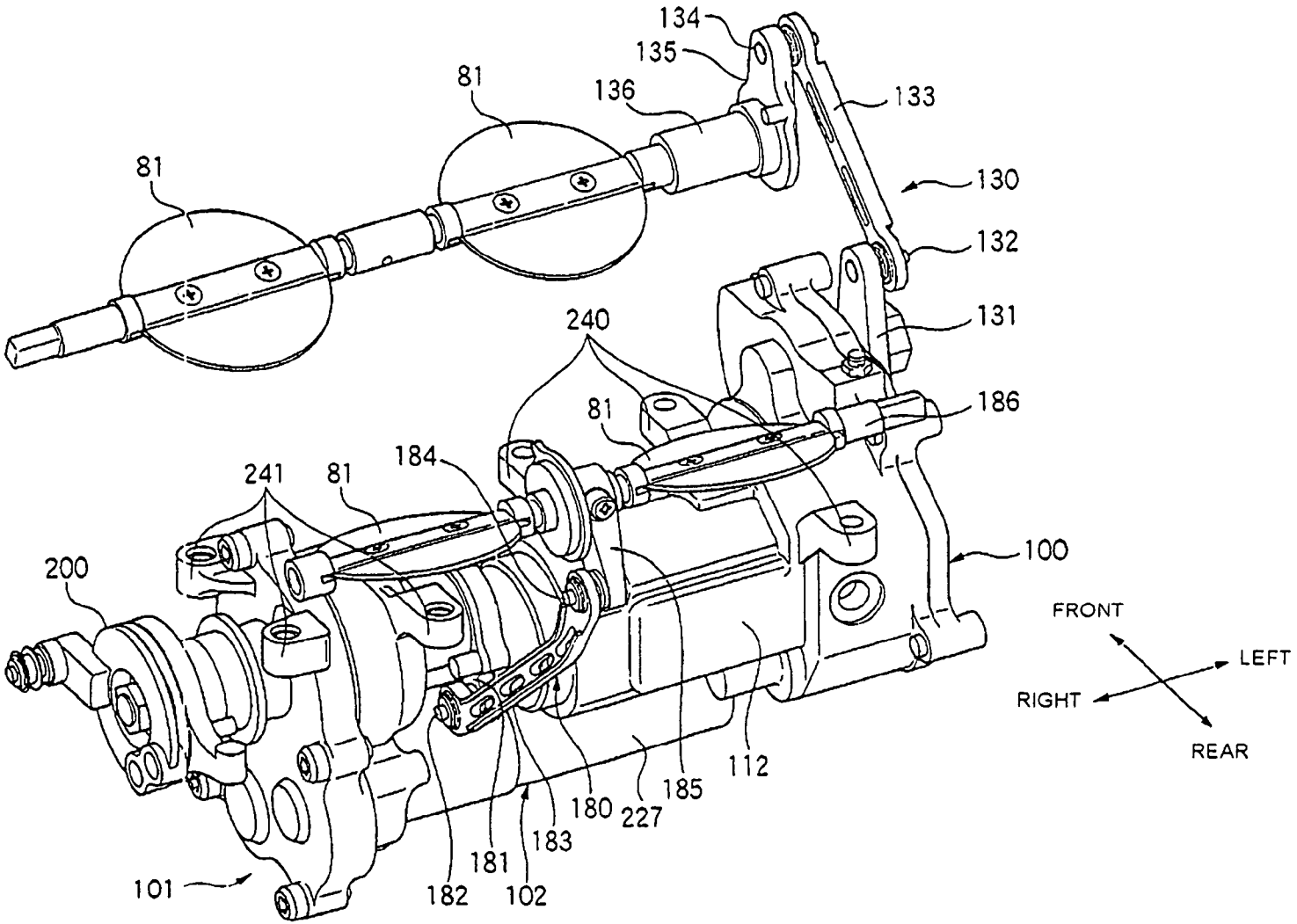
FIG. 6 is a perspective view of the throttle management apparatus used in the embodiment.

As shown in FIGS. 3 and 6, the electric throttle management apparatus 100 has a link mechanism 130 which includes a first link member 131 linked at one end to the output shaft 121, a second link member 133 linked to the other end of the first link member 131 via a link shaft 132, and a third link member 135 linked to an end of the second link member 133 via a link shaft 134. One end of the third link member 135 of the link mechanism 130 is linked to a valve shaft 136 supporting the two throttle valves 81 included in the front bank 61.

The electric throttle management apparatus 100 further includes an operation amount detection sensor (not shown) which detects the amount of operation (amount of rotation) by the rider of a throttle manipulation member such as a throttle grip 50. The electric throttle management apparatus 100 still further includes a controller (not shown) which controls the actuator 113 based on various parameters such as values detected by the operation amount detection sensor, vehicle speed, acceleration, and wheel slip ratio. Therefore, when an operation of the throttle activation member (such as a throttle grip 50) causes the actuator 113 to rotate, the output shaft 121 rotates causing, via the link mechanism 130, the two throttle valves 81 included in the front bank 61 to rotate.

The mechanical throttle management apparatus 101 mechanically drives, through manual operation of the throttle activation member such as the throttle grip 50, the throttle valves 81 for the two cylinders 68 included in the rear bank 62 out of the throttle valves 81 provided for the cylinders 67 and 68 as shown in FIG. 3. Being provided with a correction device 102, the mechanical throttle management apparatus 101 also adjusts the opening amount of each of the throttle valves 81 for the two cylinders 68 based on an electric signal generated according to selected operating conditions of the vehicle.

As shown in FIG. 5, the mechanical throttle management apparatus 101 includes a drum 200 linked via a cable 51 to the throttle activation member (i.e., throttle grip 50), an input shaft 201 attached to the drum 200, a power transmission device 202 linked to the input shaft 201, an output shaft 187 held by the power transmission device 202, a link mechanism 180 linked to the output shaft 187, an intermediate gear 204 engaged with a large gear 203 provided in the power transmission device 202, a drive gear 205 engaged with the intermediate gear 204, an actuator 206 which is, being linked to the drive gear 205 and longitudinally extending in parallel with the crankshaft 60, included in the correction device 102, and an accommodation case 207 which accommodates most part of the input shaft 201, the power transmission device 202, most part of the output shaft 187, the intermediate gear 204, the drive gear 205, and the actuator 206.

The drum 200 has a circumferential cable groove 208 around which a cable 51 can be wound, and a torsion coil spring 209 is set between the drum 200 and the accommodation case 207. The torsion coil spring 209 biases the drum 200 in the direction opposite to the direction of rotation of the drum 200 caused by turning of the throttle grip 50. Specifically, it causes the throttle valves 81 to be elastically biased in the direction of closing. The input shaft 201 is rotatably attached to the accommodation case 207 via a bearing 210, and has an input bevel gear 211 formed integrally with an end portion thereof.

The power transmission device 202 includes a split-type case section 214 rotatably attached to the accommodation case 207 via bearings 212 and 213, a cross-shaped support shaft 215 attached to the case section 214, small bevel gears 216 rotatably attached to the support shaft 215, and an input bevel gear 211 and an output bevel gear 217 engaged with the small bevel gears 216, respectively.

The case section 214 is rotatably attached to the input shaft 201 via a bearing 218 and to the output shaft 187 via a bearing 219. The case section 214 includes a case section body 220 and a cover section 221 provided on the input shaft 201 side to cover an opening portion of the case section body 220. The case section body 220 is formed integrally with the large gear 203 and supports the support shaft 215. The cover section 221 is attached to the case section body 220 with bolts 222.

The output bevel gear 217 is formed integrally with the output shaft 187. The intermediate gear 204 is a component rotatably attached to the accommodation case 207 via bearings 223. The drive gear 205 is a component rotatably attached to the accommodation case 207 via a bearing 224 and linked to a rotary shaft 225 of the actuator 206 with a bolt 226.

The actuator 206 is covered by a motor case 227. It is clamped together with the motor case 227 to the accommodation case 207 by bolts 228. The accommodation case 207 includes a first case 229 and a second case 230 which are coupled to each other by plural bolts 231.

The axes of the input shaft 201 and output shaft 187 are aligned on a single straight line. The rotary shaft 225 of the actuator 206 is disposed in parallel with the input shaft 201 and the output shaft 187. Namely, the actuator 206, having a cylindrical shape and longitudinally extending in parallel with the rotary shaft 225, is also disposed in parallel with the input shaft 201 and the output shaft 187.

A nut 232 is provided for attaching the drum 200 to the input shaft 201, 233 a bearing 233 is provided between an end portion of the output shaft 187 and an end portion of the second case 230 to rotationally support the output shaft 187, a collar 234 is provided around the output shaft 187 at a location in a section between the bearings 219 and 233, an annular spacer 235 is provided around the output shaft 187 at a location in a section between the bearing 233 and a first arm member 188, a nut 236 is provided for attaching the first arm member 188 to an end portion of the output shaft 187, and a conductor 237 is connected to the actuator 206 for energizing the actuator 206.

As shown in FIGS. 3 and 6, the mechanical throttle management apparatus 101 has a link mechanism 180 which includes a first link member 181 attached, at one end thereof, to an end portion of the output shaft 187 to be rotatable integrally with the output shaft 187, a second link member 183 one end of which is attached to the other end of the first link member 181 via a link shaft 182, and a third link member 185 linked to the other end of the second link member 183 via a link shaft 184. A valve shaft 186 holding the throttle valves 81 for the two cylinders 68 included in the rear bank 62 is attached to the third link member of this link mechanism.

In the mechanical throttle management apparatus 101, when the throttle grip 50 is turned to open the throttle valves, the rotation of the throttle grip 50 is transmitted to the drum 200 via a cable 51.

When the actuator 206 of the correction device 102 is kept stationary, the large gear 203, engaged with the drive gear 205 via the intermediate gear 204, stays still. When, in this state, the input shaft 201 connected to the drum 200 rotates, the rotation of the input shaft 201 is transmitted from the input bevel gear 211 to the small bevel gear 216, then from the small bevel gear 216 to the output bevel gear 217, causing the output shaft 187 to rotate. Since, at this time, the small bevel gear 216 rotates on its own axis, the output shaft 187 rotates at the same rotational speed as the input shaft 201 and in the opposite direction from the input shaft 201.

When the actuator 206 of the correction device 102 is operated to make the rotary shaft 225 of the actuator 206 rotate in the same direction as the input shaft 201 (i.e. in the opposite direction from the output shaft 187), the large gear 203 rotates in the same direction as the input shaft 201 and the small bevel gear 216 revolves while rotating on its own axis, causing the output shaft 187 to rotate more slowly than the input shaft 201.

Conversely, when the rotary shaft 225 of the actuator 206 is rotated in the opposite direction from the input shaft 201 (i.e. in the same direction as the output shaft 187), the large gear 203 rotates in the opposite direction from the input shaft 201 and the small bevel gear 216 revolves while rotating on its own axis, causing the output shaft 187 to rotate faster than the input shaft 201.

The mechanical throttle management apparatus 101 further includes an operation amount detection sensor (not shown) which detects the amount of operation (amount of rotation) by the rider of the throttle grip 50, and includes a controller (not shown) which controls the actuator 206 based on values detected by the operation amount detection sensor. The mechanical throttle management apparatus 101 mechanically drives the two throttle valves 81 included in the rear bank 62 according to the rotation of the throttle grip 50 that is transmitted to the drum 200 via a throttle cable 51, i.e. according to throttle grip 50 operation. When the two throttle valves 81 are driven, the controller (not shown) adjusts, as required, the rotation of the output shaft 187 by controlling the actuator 206 based on various parameters such as values detected by the operation amount detection sensor (not shown), vehicle speed, acceleration, and wheel slip ratio.

The electric throttle management apparatus 100 and mechanical throttle management apparatus 101 configured as described above are fixed to the throttle body 87 by attaching fixing portions 240 and 241 shown in FIGS. 3 and 6 to lower portions of the throttle body 87 with clamping members 242 (see FIG. 3). When the throttle management apparatus 100 and 101 fixed as described above, the actuator 113 of the electric throttle management apparatus 100 and the actuator 206 of the correction device 102 are disposed between the cylinders 67 and cylinders 68, which are arranged in a V shape. The actuator 113 of the electric throttle management apparatus 100 and the actuator 206 of the correction device 102 are positioned such that they are longitudinally in parallel with the crankshaft 60 while overlapping each other as viewed in the vertical direction.

Figure 4:
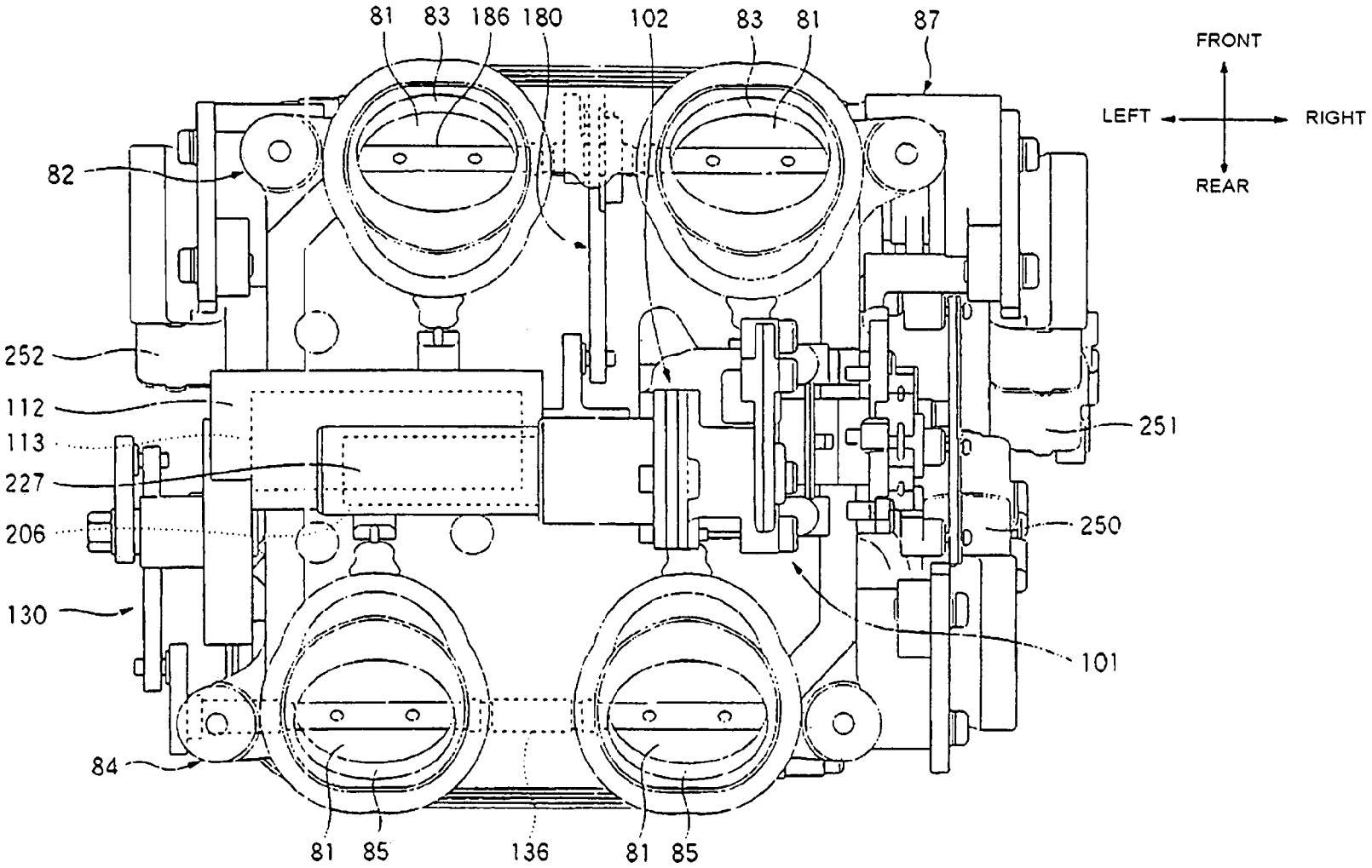
FIG. 4 is a bottom view of the intake mechanism and the electric throttle management apparatus of FIG. 2.

As shown in FIG. 4, three throttle opening sensors 250, 251, and 252 are attached to one end portion of the valve shaft 136 included in the front bank 61 and two end portions of the valve shaft 186 included in the rear bank 62, respectively. They detect the opening amount of the throttle valves 81 included in the front bank 61 and the rear bank 62, and the rotation angle of the drum 200.

According to the embodiment described above, the electric throttle management apparatus 100 drives the two throttle valves 81 for the two cylinders 67 included in the front bank 61 of the V-shaped bank based on an electric signal generated according to selected operating conditions of the vehicle, so that the output characteristic of the V-type multi-cylinder engine 13 can be arbitrarily controlled. Furthermore, the throttle valves 81 for the two cylinders 68 included in the rear bank 62 that forms, together with the front bank 61, the V-shaped bank, are mechanically driven by the mechanical throttle management apparatus 101. Therefore, during an early stage of throttle grip 50 operation in particular, the two throttle valves 81 can be driven by the mechanical throttle management apparatus 101 with good response. This makes it possible, while electrically controlling the throttle valves 81, to improve the response of the V-type multi-cylinder engine 13 to an operator's request, namely, to improve the linearity in throttle response. The above effects are obtained using the configuration including both the electric throttle management apparatus 100 and the mechanical throttle management apparatus 101. In the configuration, the drum 200 on which the cable 51 is wound is required only at one location. Also, the actuator 113 of the electric throttle management apparatus 100 can be made relatively short in the longitudinal direction. Thus, the overall configuration can be made compact.

With the correction device 102 of the mechanical throttle management apparatus 101 adjusting the openings of the throttle valves 81 based on an electric signal generated according to selected operating conditions of the vehicle, it is possible to arbitrarily set characteristics of the throttle valves 81 without a deterioration in the response during an early stage of throttle grip 50 operation. This makes it possible to more arbitrarily control the output characteristics of the V-type multi-cylinder engine 13.

Furthermore, the actuators 113 and 206 of the electric throttle management apparatus 100 and correction device 102 are disposed so as to be longitudinally in parallel with the crankshaft 60, and positioned between the cylinders 67 and cylinders 68. That is, the actuators 113 and 206 are disposed in the V-shaped opening between the front bank 61 and the rear bank 62 so as extend in the direction of the crankshaft 60. When disposed in this configuration, the actuators 113 and 206 do not require the angle formed by the V bank to be enlarged. The actuators 113 and 206, being positioned at different heights, cannot interfere with each other in the longitudinal direction, so that they can compactly disposed.

The throttle valves 81 for the cylinders 67 included in the front bank 61 of the V bank are driven by the actuator 113 of the electric throttle management apparatus 100, and the throttle valves 81 for the cylinders 68 included in the rear bank 62 of the V bank are driven by the mechanical throttle management apparatus 101 including the correction device 102, so that the respective drive mechanisms of the electric throttle management apparatus 100 and the mechanical throttle management apparatus 101 including the correction device 102 can be simplified. Also, employing a configuration in which the throttle openings minutely differ between the front bank 61 and the rear bank 62 makes it possible to minutely control the output of the V-type multi-cylinder engine 13 without raising the resolutions of the actuators 113 and 206.

While a working example of the present invention has been described above, the present invention is not limited to the working example described above, but various design alterations may be carried out without departing from the present invention as set forth in the claims.

For example, even though the actuators 113 and 206 of the electric throttle management apparatus 100 and the correction device 102, respectively, are disposed at different heights, they may be disposed along each other at a same height. In such a configuration, too, they can be compactly disposed without interfering with each other in the longitudinal direction.

What is claimed is:

1. A throttle management apparatus for an internal combustion engine of a vehicle, wherein the engine has a plurality of cylinders arranged in two spaced-apart banks, and a throttle body assembly comprising a first throttle body section and a second throttle body section spaced apart from said first throttle body section, said throttle body assembly including a respective throttle valve for each of said cylinders, and the vehicle includes a throttle activation member operatively connected to at least some of said throttle valves, wherein the throttle management apparatus controls the throttle valves, the throttle management apparatus comprising:

a first throttle control device which electrically drives the throttle valves for some of the plurality of cylinders disposed in a first bank of said engine, based on an electric signal generated according to selected operating conditions of the vehicle, wherein operation of the throttle valves of said first bank is controlled exclusively by said first throttle control device; and a second throttle control device which mechanically drives the throttle valves for the rest of the plurality of cylinders disposed in a second bank of said engine, based on an amount of throttle activation member operation;

wherein the first and second throttle control devices are disposed in a space formed between the first and second throttle body sections;

and wherein the second throttle control device is configured and arranged to mechanically control the throttle valves of said second bank during an early stage of throttle grip operation, so as to provide relatively rapid response to manual manipulation of said throttle activation member during said early stage of throttle grip operation.

2. The throttle management apparatus for an internal combustion engine according to claim 1, wherein the selected operating conditions of the vehicle include at least one of throttle activation member position, vehicle speed, vehicle acceleration, and wheel slip ratio.

3. The throttle management apparatus for an internal combustion engine according to claim 1, wherein the second throttle control device is mechanically linked to the throttle activation member using a cable, such that when the throttle activation member is operated, movement of the throttle activation member is transmitted to the second throttle control device via the cable.

4. The throttle management apparatus for an internal combustion engine according to claim 1, wherein the first throttle control device comprises an actuator and a linkage which connects the actuator to the throttle valves for some of the plurality of cylinders, and wherein the actuator drives the linkage to generate movement of the throttle valves for some of the plurality of cylinders based on an electric signal generated according to selected operating conditions of the vehicle.

5. The throttle management apparatus for an internal combustion engine according to claim 1, wherein the second throttle control device comprises:

a drum linked via a cable to the throttle activation member such that operation of the throttle activation member results in a rotation of the drum;

an actuator which provides a rotational output via an actuator output shaft based on the electric signal generated according to selected operating conditions of the vehicle;

a transmission device operatively connected to both the drum and the actuator output shaft; and a linkage, which transmits movement from the transmission device to the throttle valves for the rest of the plurality of cylinders, wherein the transmission device receives rotational input from one of the drum and the actuator output shaft, and transmits movement to the throttle valves for the rest of the plurality of cylinders via the linkage.

6. The throttle management apparatus for an internal combustion engine according to claim 1, wherein the second throttle control device comprises a correction device that corrects the opening amount of the throttle valves for the rest of the plurality of cylinders based on the electric signal generated according to selected operating conditions of the vehicle.

7. The throttle management apparatus for an internal combustion engine according to claim 6, wherein:

the engine further comprises a crankshaft, axes of the respective banks are arranged to form a V shape, and an actuator of the first throttle control device and an actuator of the correction device are disposed in a V-shaped opening between the respective banks, and the actuator of the first throttle control device drives the throttle valves for cylinders included in the first bank of said two banks, and the second throttle control device having the correction device drives the throttle valves for cylinders included in the second bank of said two banks.

8. The throttle management apparatus for an internal combustion engine according to claim 6, wherein:

the engine further comprises a crankshaft, axes of the respective banks are arranged to form a V shape, and an actuator of the first throttle control device and an actuator of the correction device are disposed in a V-shaped opening between the respective banks such that the actuators are longitudinally in parallel with a crankshaft while mutually overlapping as viewed in a vertical direction.

9. A vehicle comprising:

an internal combustion engine having a plurality of cylinders arranged in two spaced-apart banks, said engine comprising:

a throttle body assembly comprising a first throttle body section and a second throttle body section spaced apart from said first throttle body section, said throttle body assembly including a respective throttle valve for each of said cylinders;

a throttle activation member operatively connected to at least some of said throttle valves; and a throttle management apparatus which controls the throttle valves;

wherein the throttle management apparatus comprises:

a first throttle control device which electrically drives the throttle valves for some of the plurality of cylinders disposed in a first bank of said engine, based on an electric signal generated according to selected operating conditions of the vehicle; and a second throttle control device which mechanically drives the throttle valves for the rest of the plurality of cylinders disposed in a second bank of said engine, based on an amount of throttle activation member operation;

wherein the first and second throttle control devices are disposed in a space formed between the first and second throttle body sections;

and wherein the second throttle control device is configured and arranged to mechanically control the throttle valves of said second bank during an early stage of throttle grip operation, so as to provide relatively rapid response to manual manipulation of said throttle activation member during said early stage of throttle grip operation.

10. The vehicle according to claim 9, wherein the selected operating conditions of the vehicle include at least one of throttle activation member position, vehicle speed, vehicle acceleration, and wheel slip ratio.

11. vehicle according to claim 9, wherein the second throttle control device is mechanically linked to the throttle activation member using a flexible link, such that when the throttle activation member is operated, movement of the throttle activation member is transmitted to the second throttle control device via the flexible link.

12. The vehicle according to claim 9, wherein the first throttle control device comprises an actuator and a linkage which connects the actuator to the throttle valves for some of the plurality of cylinders, and wherein the actuator drives the linkage to generate movement of the throttle valves for some of the plurality of cylinders based on an electric signal generated according to selected operating conditions of the vehicle.

13. The vehicle according to claim 9, wherein the second throttle control device comprises:

a drum linked via a cable to the throttle activation member such that operation of the throttle activation member results in a rotation of the drum;

an actuator which provides a rotational output via an actuator output shaft based on the electric signal generated according to selected operating conditions of the vehicle;

a transmission device operatively connected to both the drum and the actuator output shaft; and a linkage, which transmits movement from the transmission device to the throttle valves for the rest of the plurality of cylinders, wherein the transmission device receives rotational input from one of the drum and the actuator output shaft, and transmits movement to the throttle valves for the rest of the plurality of cylinders via the linkage.

14. The vehicle according to claim 9, wherein the second throttle control device comprises a correction device that corrects the opening amount of the throttle valves for the rest of the plurality of cylinders based on the electric signal generated according to selected operating conditions of the vehicle.

15. The vehicle according to claim 14, wherein:

the engine further comprises a crankshaft, axes of the respective banks are arranged to form a V shape, and an actuator of the first throttle control device and an actuator of the correction device are disposed in a V-shaped opening between the respective banks such that the actuators are longitudinally in parallel with a crankshaft while mutually overlapping as viewed in a vertical direction.

16. The vehicle according to claim 15, wherein:

the actuator of the first throttle control device drives the throttle valves for cylinders included in a first bank of said two banks, and the second throttle control device having the correction device drives the throttle valves for cylinders included in a second bank of said two banks.

17. In an internal combustion engine for a vehicle having a first bank of cylinders and a second bank of cylinders, said first and second banks arranged in a V configuration with an open space defined therebetween, the improvement comprising a throttle management apparatus comprising:

a first throttle body section and a second throttle body section spaced apart from said first throttle body section, said throttle body assembly including a respective throttle valve for each of said cylinders, wherein the vehicle includes a throttle activation member operatively connected to at least some of said throttle valves, a first throttle control device which is operable to electrically drive the throttle valves for the cylinders disposed in the first bank of said engine, based on an electric signal generated according to selected operating conditions of the vehicle, wherein operation of the throttle valves of said first bank is controlled exclusively by said first throttle control device; and a second throttle control device which mechanically drives the throttle valves for the cylinders disposed in the second bank of said engine, based on an amount of throttle activation member operation, said second throttle control device also comprising a correction device for correcting the opening amount of the throttle valves for the cylinders of the second bank based on the electric signal generated according to selected operating conditions of the vehicle;

wherein the first and second throttle control devices are disposed in a space formed between the first and second throttle body sections;

and wherein the second throttle control device is configured and arranged to mechanically control the throttle valves of said second bank during an early stage of throttle grip operation, so as to provide relatively rapid response to manual manipulation of said throttle activation member during said early stage of throttle grip operation.

18. The engine of claim 17, wherein the first throttle control device includes a first transmission gear assembly which is disposed toward the outside of the space between the first and second throttle body sections, and an actuator including a motor case which is disposed inwardly of the first transmission gear assembly, and wherein the correction device of the second throttle control device includes a second transmission gear assembly which is disposed toward the outside of the space between the first and second throttle body sections at a side of the engine opposite the first transmission gear assembly, and an actuator including a motor case which is disposed inwardly of the second transmission gear assembly.

* * * * *